US011367378B2

(12) United States Patent
Hsieh et al.

(10) Patent No.: US 11,367,378 B2
(45) Date of Patent: Jun. 21, 2022

(54) DRIVING METHOD AND DISPLAY DEVICE

(71) Applicant: AU Optronics Corporation, Hsin-Chu (TW)

(72) Inventors: Pei-Lin Hsieh, Hsin-Chu (TW); Che-Ming Hsu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/235,613

(22) Filed: Apr. 20, 2021

(65) Prior Publication Data

US 2022/0005396 A1 Jan. 6, 2022

(30) Foreign Application Priority Data

Jul. 2, 2020 (TW) ..... 109122464

(51) Int. Cl.
*G09G 3/20* (2006.01)

(52) U.S. Cl.
CPC ... *G09G 3/2003* (2013.01); *G09G 2300/0413* (2013.01); *G09G 2310/027* (2013.01); *G09G 2330/12* (2013.01)

(58) Field of Classification Search
CPC ..... G09G 3/2003; G09G 2300/0413; G09G 2310/027; G09G 330/12
See application file for complete search history.

(56) References Cited

U.S. PATENT DOCUMENTS

2008/0315788 A1 12/2008 Levey et al.
2019/0215472 A1* 7/2019 Lee ..... H01L 25/167

FOREIGN PATENT DOCUMENTS

CN 109448638 A 3/2019
CN 110277058 A 9/2019

OTHER PUBLICATIONS

Chih-Lung Lin, A Novel LTPS-TFT Pixel Circuit Compensating for TFT Threshold-Voltage Shift and OLED Degradation for AMOLED, IEEE Electron Device Letters, vol. 28, pp. 129-131, Feb. 2007.

* cited by examiner

*Primary Examiner* — Kenneth B Lee, Jr.
(74) *Attorney, Agent, or Firm* — WPAT, PC

(57) ABSTRACT

A driving method includes the following steps: driving a first dummy pixel circuit according to a first test signal, and driving a display pixel circuit according to a driving signal, wherein the first test signal is maintained at a value corresponding to a first gray level; detecting a detection voltage change value cross a light-emitting element in the display pixel circuit is driven for a driving time, and detecting a first test voltage change value cross a light-emitting element in the first dummy pixel circuit is driven for the driving time; and adjusting the driving signal according to the detection voltage change value, the first test voltage change value and a second test voltage change value, wherein the second test voltage change value is obtained by detecting a second dummy pixel circuit or from a memory unit.

16 Claims, 8 Drawing Sheets

100

111

110

DRIVING METHOD AND DISPLAY DEVICE

CROSS-REFERENCE TO RELATED APPLICATION

This application claims priority to Taiwan Application Serial Number 109122464, filed Jul. 2, 2020, which is herein incorporated by reference in its entirety.

BACKGROUND

Technical Field

The present disclosure relates to a driving method and a display device, especially for compensating the driving signal according to the degradation degree of the light-emitting element.

Description of Related Art

With the rapid development of electronic technology, display devices are widely used in daily life, such as smart phones or computers. The display device is used to display a corresponding image by separately controlling the brightness of each pixel on the display panel in different frames. However, since the electronic components in the display device will gradually degrade with the driving time, it is necessary to compensate the driving signal to ensure the display quality.

SUMMARY

One aspect of the present disclosure is a driving method, comprising the following steps: driving a first dummy pixel circuit according to a first test signal, and driving a display pixel circuit according to a driving signal, wherein the first test signal is maintained at a value corresponding to a first gray level; detecting a detection voltage change value cross a light-emitting element in the display pixel circuit is driven for a driving time, and detecting a first test voltage change value cross a light-emitting element in the first dummy pixel circuit is driven for the driving time; and adjusting the driving signal according to the detection voltage change value, the first test voltage change value and a second test voltage change value, wherein the second test voltage change value is obtained by detecting a second dummy pixel circuit or from a memory unit.

Another aspect of the present disclosure is a display device, comprising a display panel and a processor. The display panel comprises a first dummy pixel circuit and a display pixel circuit. The display panel is configured to drive the first dummy pixel circuit according to a first test signal, and drive the display pixel circuit according to a driving signal, the first test signal is maintained at a value corresponding to a first gray level. The processor is electrically coupled to the display panel, and is configured to obtain a first test voltage change value cross a light-emitting element in the first dummy pixel circuit. The processor is configured to obtain a detection voltage change value cross a light-emitting element in the display pixel circuit. The processor is configured to adjust the driving signal according to the detection voltage change value, the first test voltage change value and a second test voltage change value. The second test voltage change value is obtained by detecting a second dummy pixel circuit or from a memory unit.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1A:
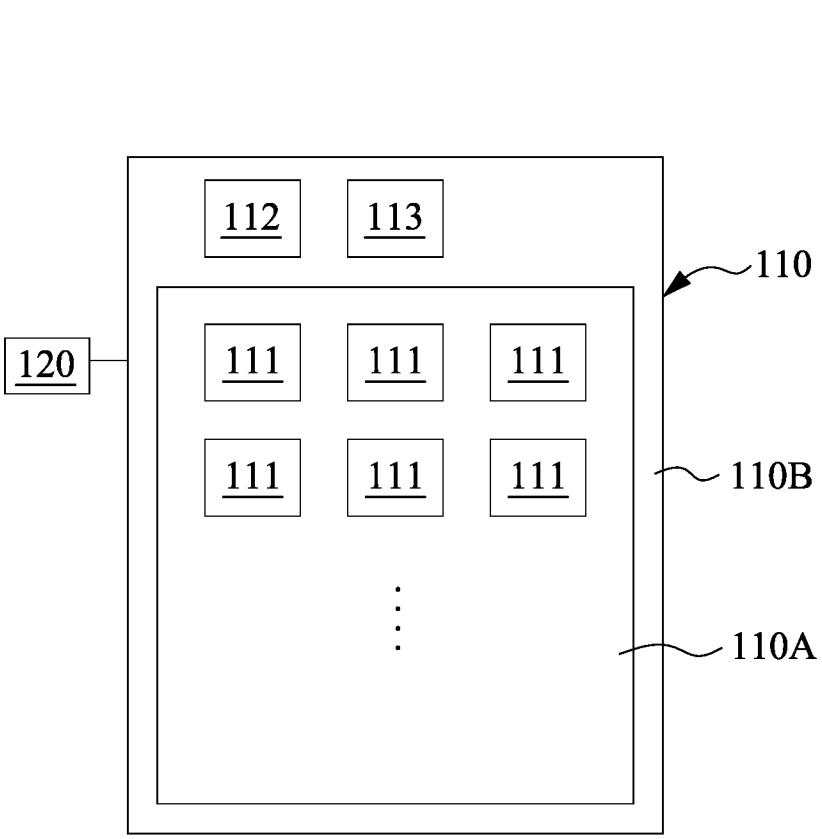
FIG. 1A is a schematic diagram of a display device in some embodiments of the present disclosure.

The present disclosure relates to a display device and a driving method. FIG. 1A is a schematic diagram of a display device in some embodiments of the present disclosure. The display device 100 includes a display panel 110 and a processor 120. The display panel 110 has multiple display pixel circuits 111. The display pixel circuits 111 are arranged on a display area 110A in the display panel 110. In other words, when the display pixel circuit 111 is driven, the light generated by the display pixel circuit 111 forms to a image screen on the display area 110A.

As shown in FIG. 1A, the processor 120 is electrically coupled to the display panel 110, and is configured to drive the display pixel circuits 111. In some embodiments, the processor 120 couple to the display panel 110 through multiple data lines and multiple scan lines (not shown in the figure), so as to respectively drive the display pixel circuits 111. The processor 120 is configured to transmit the driving signal to the display pixel circuit 111, so that the light-emitting element in the display pixel circuit 111 generates light according to the driving signal. "The driving signal" is generated by the processor 120 according to a gray level command in the image data, and is configured to control the light generated by each of the light-emitting elements of the display pixel circuit 111. The driving signal changes with time. For example, in the first frame period when the display device 100 displays the first frame, the driving signal may correspond to the grayscale value "35"; in the second frame period when the display device 100 displays the second image, the driving signal can correspond to the grayscale value "65".

Figure 1B:
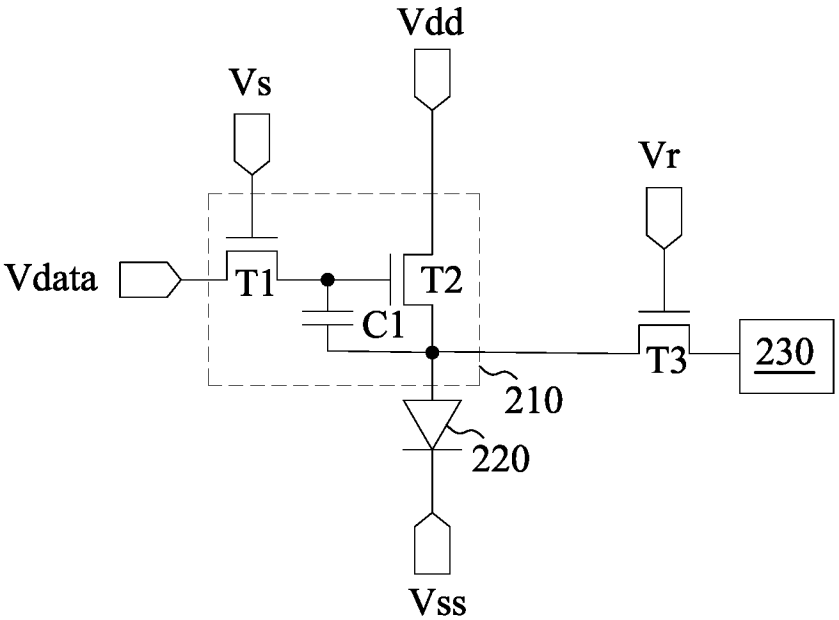
FIG. 1B is a schematic diagram of a display pixel circuit in some embodiments of the present disclosure.

FIG. 1B is a schematic diagram of a display pixel circuit in some embodiments of the present disclosure. The display pixel circuit 111 includes a driving circuit 210 and a light-emitting element 220. In some embodiments, the driving circuit 210 includes two transistor switches T1, T2 and a capacitor C1. The driving circuit 210 receives a scan signal Vs, a driving signal Vdata and power supply signals Vdd/Vss, so as to control the turn on and off of the transistor switch T1, T2, and control the current provide to the light-emitting element 220. The display pixel circuit 111 further includes a transistor switch T3. The transistor switch T3 is electrically coupled between the detection circuit 230 and the light-emitting element 220. In some embodiments, the detection circuit 230 is arranged on a non-transparent area 1108 outside the display area 110A shown in FIG. 1A, but the present disclosure is not limited to this. In some embodiments, the detection circuit 230 can also be packaged in a single chip together with the processor 120. When the processor 120 transmits a detection signal Vr to turn on the transistor switch T3, the detection circuit 230 detects the voltage change value across the two terminals of the light-emitting element 220, and transmits the detected detection voltage change value to the processor 120. In some embodiments, the power supply signal Vss may ground potential, so the detection circuit 230 is electrically coupled to a node between the driving circuit 210 and the light-emitting element 220, so as to determine the voltage variation. In some other embodiments, the detection circuit 230 is electrically coupled to two terminals of the light-emitting element 220 to detect the voltage change value.

In some embodiments, the display device 100 includes multiple detection circuits 230. Each of the detection circuits 230 is configured to detect the across voltage of the light-emitting element 220. The detection circuit 230 includes an analog-to-digital converter, an integrator, one or more stage amplifiers or combinations thereof.

In some other embodiments, the processor 120 may be Data Driving Integrated Circuit (DDIC), Field Programmable Gate Array (FPGA), Application-specific integrated circuit (ASIC) or a combination thereof.

In some embodiments, the light-emitting element 220 can be an organic light-emitting diode, but the present disclosure is not limited to this. After the light-emitting element 220 is driven for a period of time, the light-emitting element 220 will degrade. For example, when driven by the same driving signal (or driving current), the degraded light-emitting element 220 has a higher cross-voltage and exhibits lower brightness. Therefore, the display device 100 must adjust (i.e., compensate) the driving signal Vdata to make the degraded light-emitting element 220 produce the expected brightness.

As mentioned above, the degradation speed of the light-emitting element 220 is related to the strength of the driving period. The driving signal varies according to the image signal that the display device 100 needs to display, so it is not a fixed value. Therefore, there is no one degradation characteristic model that can accurately know in advance the degradation degree of the light-emitting element 220 of the display device 100 after a long operation period. The present disclosure uses an additional "dummy pixel circuit" as the reference data for comparison, so that the processor 120 can calculate the expected degradation degree of the light-emitting element in the display pixel circuit 111 according to the reference data.

Specifically, as shown in FIG. 1A, in some embodiments, the display panel 110 includes a first dummy pixel circuit 112. The first dummy pixel circuit 112 includes a driving circuit, a light-emitting element and a detection circuit, the circuit structure of the first dummy pixel circuit 112 can be the same as that shown in FIG. 1B, but it is not limited to this. The difference between the first dummy pixel circuit 112 and FIG. 1B is that the driving circuit of the first dummy pixel circuit 112 receives the first test signal from the processor 120 through the transistor switch, and drives the light-emitting element to generate the corresponding brightness according to the strength of the first test signal. Since people in the art can understand the circuit structure, it is not repeated here.

In some embodiments, the first dummy pixel circuit 112 is arranged in the non-transparent area 110B outside the display area 110A. In other words, the light generated by the first dummy pixel circuit 112 can be blocked by a non-transparent housing of the display panel 110. When the first dummy pixel circuit 112 is driven by the processor 120, the detection circuit coupled to the first dummy pixel circuit 112 is configured to detect the cross voltage change of the light-emitting element of the first dummy pixel circuit 112 (Referred to as "the first test voltage change value" in the subsequent paragraphs). The detection circuit coupled to the first dummy pixel circuit 112 further transmits a first test voltage change value to the processor 120. The first test signal is maintained to correspond to the first gray level (e.g., gray level value "255"). That is, in each frame period of the display device 100, the first test signal provided by the processor 120 to the first dummy pixel circuit 112 corresponds to the same first gray level.

Accordingly, since the first dummy pixel circuit 112 is driven by the fixed first test signal, and the driving time of the first dummy pixel circuit 112 is the same as the driving time of the display pixel circuit 111, the processor 120 obtains a first degradation degree of the light-emitting element in the first dummy pixel circuit 112 according to the first test voltage change value. In addition, the processor 120 obtains a second degradation degree according to the second test voltage change value stored in advance and corresponding to the current driving time (the method of obtaining the second test voltage change value will be explained in the following paragraphs). The processor 120 uses the first degradation degree and the second degradation degree, which are corresponding to the first test voltage change value and the second test voltage change value, as two calculation basis. According to these two calculation basis and the detection voltage change value, the processor 120 can estimate the current degradation degree of the light-emitting element 220 in the display pixel circuit 111, and adjust it accordingly to compensate for the driving signal.

Figure 2:
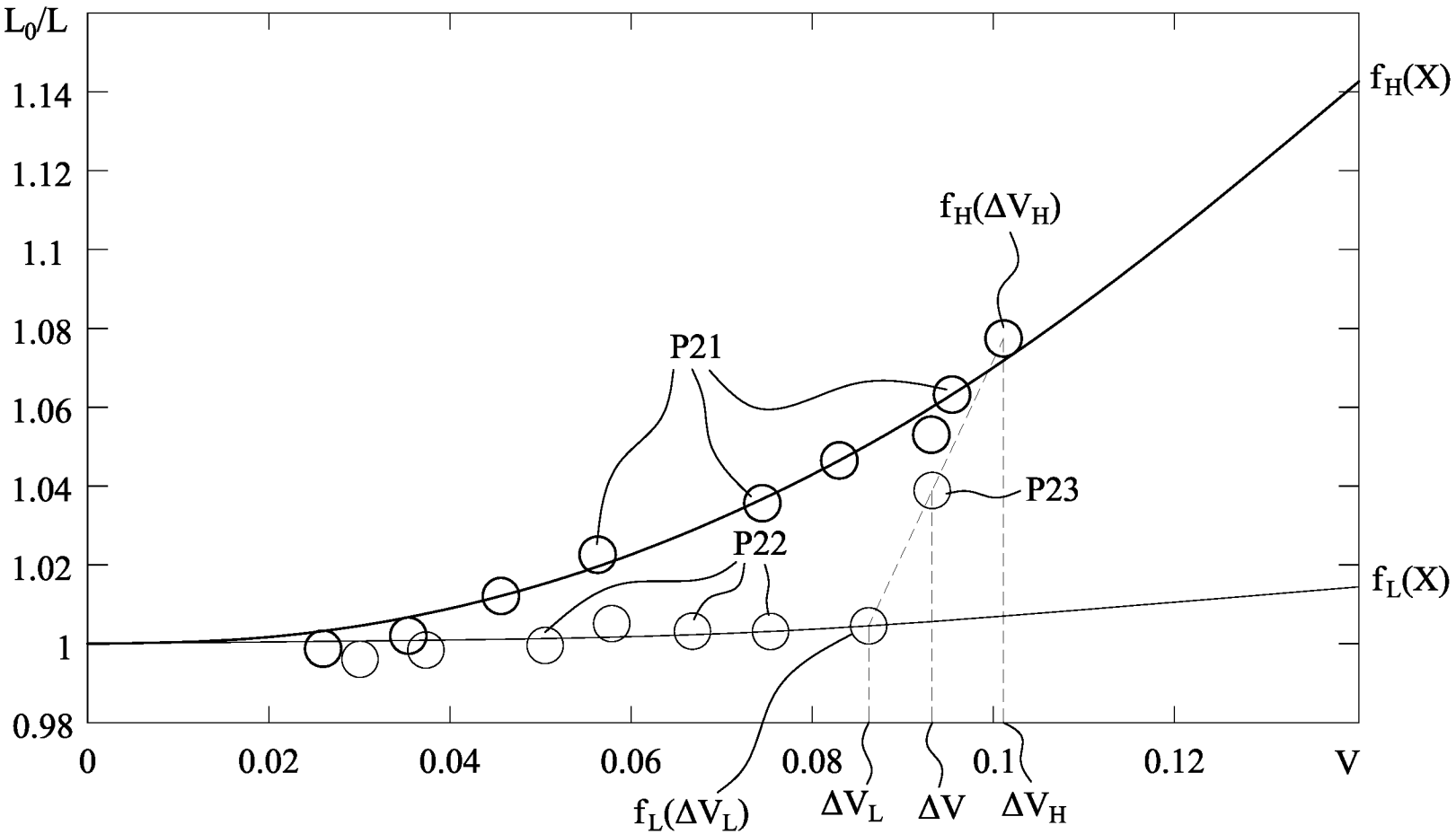
FIG. 2 is a schematic diagram of the degradation characteristic model.

FIG. 2 is a schematic diagram of the degradation characteristic model. The degradation characteristic model can be stored in the memory unit of the display device 100 (not shown in the figure, such as memory) or stored in the processor 120 in advance. The horizontal axis represents the voltage change value of the light-emitting element. The vertical axis represents the degradation degree corresponding to the voltage change value of the light-emitting element. The "degradation degree" is defined as the value obtained by dividing the ideal brightness $L_0$ of the light-emitting element by the actual brightness L when the light-emitting element is driven by the same driving signal. The degradation characteristic model shown in FIG. 2 includes two degradation curve $f_H(x)$, $f_L(x)$. The degradation curve $f_H(x)$ can be an degradation trend generated by the light-emitting element being continuously used to display the grayscale value "255" (the highest grayscale) in the experiment of the product development process, which is formed by multiple sampling points P21. The degradation curve $f_L(x)$ can be the degradation trend when the light-emitting element is continuously used to display the grayscale value "1" (the lowest grayscale) in the experiment of the product development process, which is formed by multiple sampling points P22.

For example, when the display device 100 is driven for a period of the driving time, the processor 120 obtains a detection voltage change value of the light-emitting element in the display pixel circuit 111 is "0.092" by one or more detection circuits 230, and obtains a first test voltage change value of the light-emitting element in the first dummy pixel circuit 112 is "0.1". At the same time, according to the degradation characteristic model (i.e., the degradation curve $f_L(x)$) of the processor 120 can be known by looking up the table: If the light-emitting element is driven by a fixed second test signal for the same driving time, then the light-emitting element will have the second test voltage change value "0.083". The processor 120 determines the weight value w according to a difference between the detection voltage change value, the first test voltage change value and the second test voltage change value. The specific formula is as follows:

$$\omega = \frac{\Delta V - \Delta V_L}{\Delta V_H - \Delta V_L}$$

In the above formula, ΔV is the detection voltage change value, $\Delta V_L$ is the second test voltage change value, and $\Delta V_H$ is the first test voltage change value. After calculating the weight value ω, the processor 120 will further obtain a corresponding first degradation degree $f_H(\Delta V_H)$ and a corresponding second degradation degree $f_L(\Delta V_L)$ according to the first test voltage change value $\Delta V_H$ and the second test voltage change value $f_L(\Delta V_L)$. Then, the processor 120 calculates an estimated degradation degree $L_0/L$ of the light-emitting element 220 in the display pixel circuit 111 according to the following formula (That is, estimate the estimated point P23 that the light-emitting element 220 in the display pixel circuit 111 should correspond to):

$$\begin{aligned}\frac{L_0}{L} &= f(\Delta V) = f_L(\Delta V_L) + \frac{\Delta V - \Delta V_L}{\Delta V_H - \Delta V_L}[f_H(\Delta V_H) - f_L(\Delta V_L)] \\ &= (1-\omega) f_L(\Delta V_L) + \omega f_L(\Delta V_H)\end{aligned}$$

After calculating the estimated degradation degree $L_0/L$, the processor 120 will adjust the driving signal according to the estimated degradation degree $L_0/L$. The specific formula is as follows, wherein $D_{in}$ is the grayscale data signal received by the processor 120, and $D_{out}$ is the grayscale data signal adjusted and compensated by the processor. The compensated grayscale data signal can be provided to the display pixel circuit as the driving signal Vdata to compensate for the brightness attenuation of the light-emitting element 220.

$$D_{out} = D_{in} \times \sqrt[2.2]{\frac{L_0}{L}} = D_{in} \times \sqrt[2.2]{f(\Delta V)}$$

The above formula is a straight line formed by the sampling point P21 corresponding to the first degradation degree $f_H(\Delta V_H)$ and the sampling point P22 corresponding to the second degradation degree $f_L(\Delta V_L)$ in the FIG. 2, which is generated according to the difference between the detection voltage change value ΔV, the first test voltage change value $\Delta V_H$ and the second test voltage change value $\Delta V_L$. In other embodiments, the line between the two sampling points P21 and P22 is not limited to a straight line, but can also be set as a curve (can be set according to the characteristics of the light-emitting element), it is used to calculate the estimated degradation degree $L_0/L$.

In the above embodiments, the second test voltage change value is obtained by the processor 120 according to the current driving time and the degradation characteristic model stored in advance (i.e., the degradation curve $f_L(x)$). As shown in FIG. 1A, in some other embodiments, a second dummy pixel circuit 113 may be provided on the display panel 110. The second dummy pixel circuit 113 is arranged in the non-transparent area 1108. The display panel 110 is configured to drive the second dummy pixel circuit 113 according to a second test signal, and the second test signal is maintained to correspond to a second gray level. The second gray level is different from the first gray level. For example, the first gray level is a white screen with a grayscale value between 240-255. The second gray level is a black screen with a grayscale value between 0-10. In some embodiments, the difference between the first gray level and the second gray level is larger than 200.

As mentioned above, when the second dummy pixel circuit 113 is driven by the processor 120, the detection circuit coupled to the second dummy pixel circuit 113 is configured to detect the second test voltage change value of the light-emitting element of the second dummy pixel circuit 113. In other words, the second test voltage change value is a voltage variation after a light-emitting element is driven by a second test signal for the driving time. The detection circuit coupled to the second dummy pixel circuit 113 transmits the second test voltage change value to the processor 120. The internal circuit of the second dummy pixel circuit 113 is similar to the first dummy pixel circuit 112, so it will not repeat it here.

Figure 3:
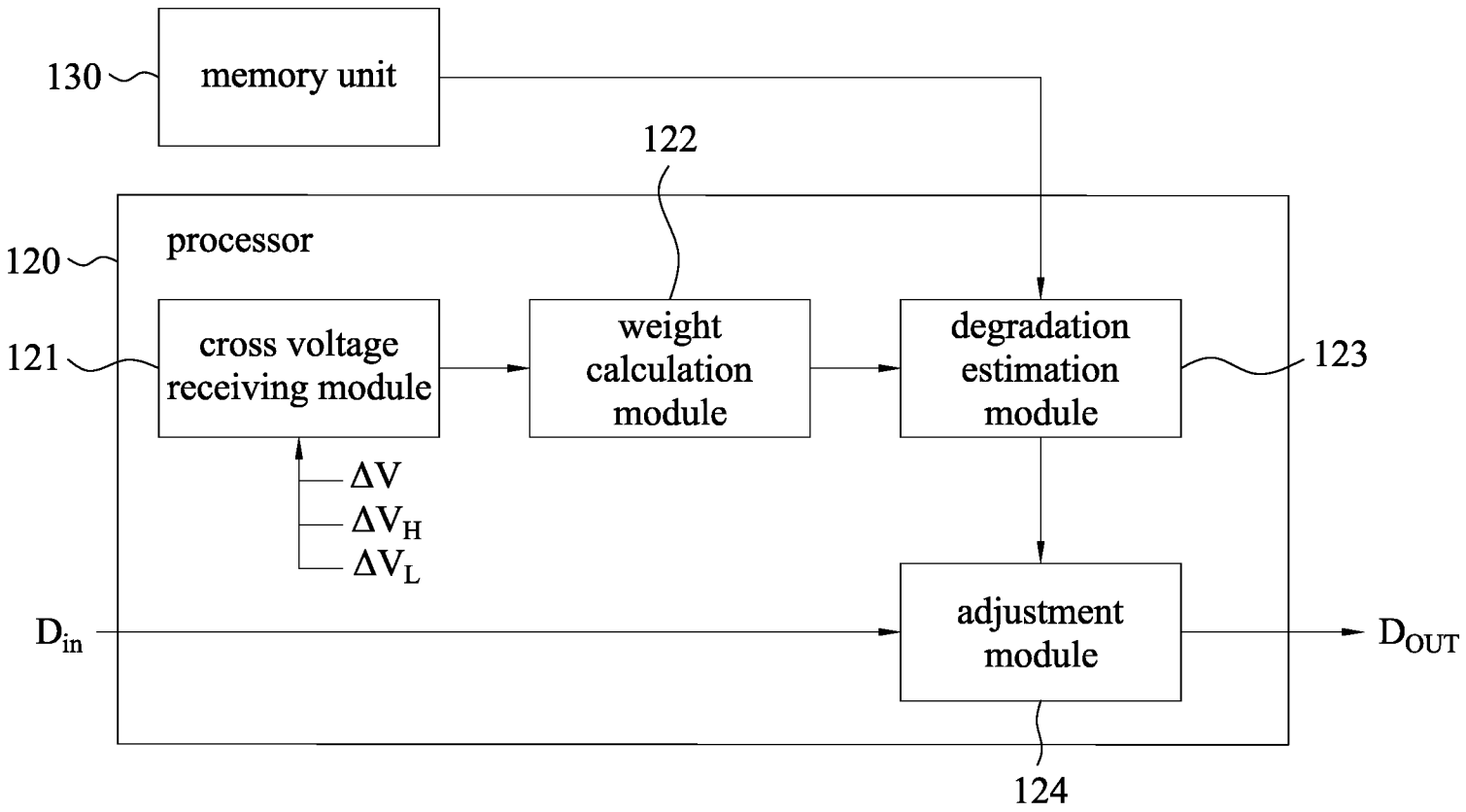
FIG. 3 is a schematic diagram of a driving method in some embodiments of the present disclosure.

FIG. 3 is a schematic diagram of a driving method in some embodiments of the present disclosure. As shown in FIG. 3, the processor 120 is electrically coupled to the memory unit 130 in the display device 100. The memory unit 130 stores an degradation characteristic model (e.g., the degradation curve $f_H(x)$, $f_L(x)$). The processor 120 further includes a cross voltage receiving module 121, the weight calculation module 122, the degradation estimation module 123 and the adjustment module 124. When the processor 120 receives a driving signal $D_{in}$, the cross voltage receiving module 121 is configured to obtain the display pixel circuit 111, the detection voltage change value ΔV of the first dummy pixel circuit 112 and/or of the second dummy pixel circuit 113, the first test voltage change value $\Delta V_H$, and/or the second test voltage change value ΔV by the detection circuit. The weight calculation module 122 is configured to calculate the weight value according to the voltage change value. The degradation estimation module 123 is configured to obtain parameters in the degradation characteristic model (e.g., the degradation curve $f_H(x)$, the degradation curve $f_L(x)$) from the memory unit 130. The adjustment module 124 compensates the driving signal $D_{in}$ according to the estimated degradation degree $L_0/L$ calculated from the degradation estimation module 123, and outputs the adjusted driving signal $D_{out}$.

Figure 4:
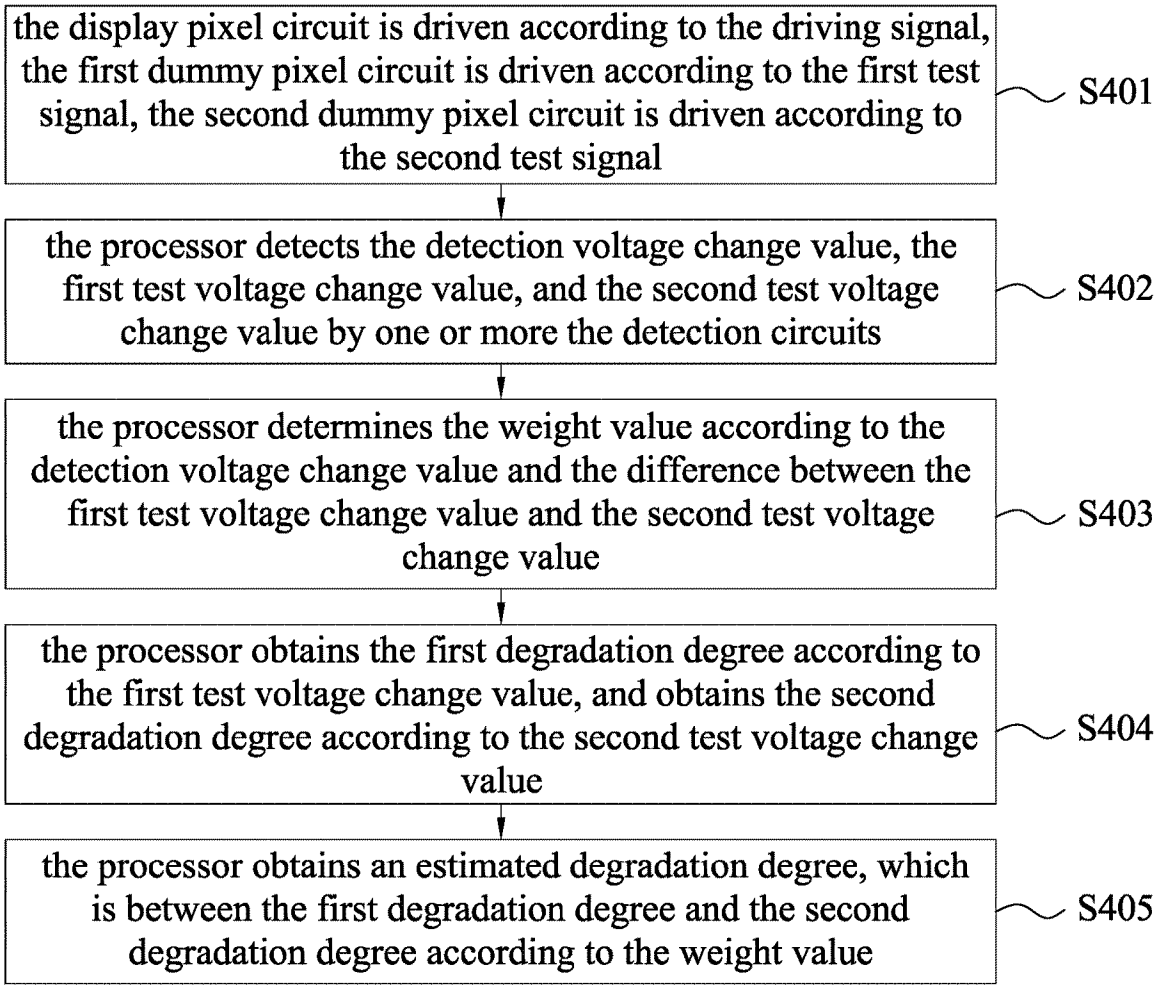
FIG. 4 is a flowchart illustrating a driving method in some embodiments of the present disclosure.

FIG. 4 is a flowchart illustrating a driving method in some embodiments of the present disclosure. In step S401, the display pixel circuit 111 is driven according to the driving signal, the first dummy pixel circuit 112 is driven according to the first test signal, the second dummy pixel circuit 113 is driven according to the second test signal. The driving time of the pixel circuits 111-113 are the same, where the driving signal can change over time, and the first test signal and the second test signal are maintained at the first gray level (for example, the highest gray level value 255) and the second gray level (for example, the lowest gray level value is 0).

In step S402, the processor 120 detects the detection voltage change value of the light-emitting element 220 in the display pixel circuit 111 after the driving time by one or more detection circuits corresponding to the pixel circuits 111-113 in the display device 100. The processor 120 further detects the first test voltage change value of the light-emitting element in the first control pixel circuit 112 after the driving time, and the second test voltage change value of the light-emitting element in the second comparison pixel circuit 113 after the driving time.

As mentioned above, in some embodiments, if the display panel 110 does not have the second dummy pixel circuit 113, the processor 120 can obtain the second test voltage change value corresponding to the driving time according to the degradation characteristic model (e.g., the degradation curve $f_L(x)$) stored in the memory unit.

In step S403, the processor 120 determines the weight value according to the detection voltage change value and the difference between the first test voltage change value and the second test voltage change value. In step S404, the processor 120 obtains the first degradation degree $f_H(\Delta V_H)$ according to the first test voltage change value by the degradation characteristic model, and obtains the second degradation degree $f_H(\Delta V_L)$ according to the second test voltage change value by the degradation characteristic model.

In step S405, after obtaining the weight value, the first degradation degree $f_H(\Delta V_H)$ and the second degradation degree $f_H(\Delta V_L)$, the processor 120 will be able to obtain an estimated degradation degree $L_0/L$, which is between the first degradation degree $f_H(\Delta V_H)$ and the second degradation degree $f_H(\Delta V_L)$ according to the weight value.

As shown in FIG. 2, in this embodiment, the first degradation curve $f_H(x)$ and the second degradation curve $f_L(x)$ represent the driving situation of the light-emitting element being maintained at the highest grayscale value "255" and the lowest grayscale value "1", respectively. Therefore, the change of the first degradation curve $f_H$ is the most dramatic, and the change of the second degradation curve $f_L$ is the smallest. Therefore, it can be reasonably to know that the degradation degree of the light-emitting element 220 of the display pixel circuit 111 must be between the first degradation degree $f_H(\Delta V_H)$ and the second degradation degree $f_H(\Delta V_L)$. Through the above steps S401-S405, the closest degree of degradation can be estimated for compensation.

As shown in FIG. 1A, since the driving signal received by each of the display pixel circuits 111 on the display panel 110 is different, the display device 120 will calculate the driving signal to be compensated and adjusted for each of the display pixel circuit 111 respectively.

In addition, in some embodiments, the display pixel circuit 111 corresponds to one of the sub-pixels (e.g., red, green or blue) of a complete pixel in an image frame. In other words, the processor 120 will calculate the adjustment value of the driving signal compensation for each sub-pixel. In other embodiments, the display panel 110 can also set the pixel circuits corresponding to different light colors. For example, the display panel 110 includes a first red comparison pixel circuit and a second red comparison pixel circuit (not shown in figure), so as to compensate the driving signal corresponding to the red sub-pixel.

Figure 5:
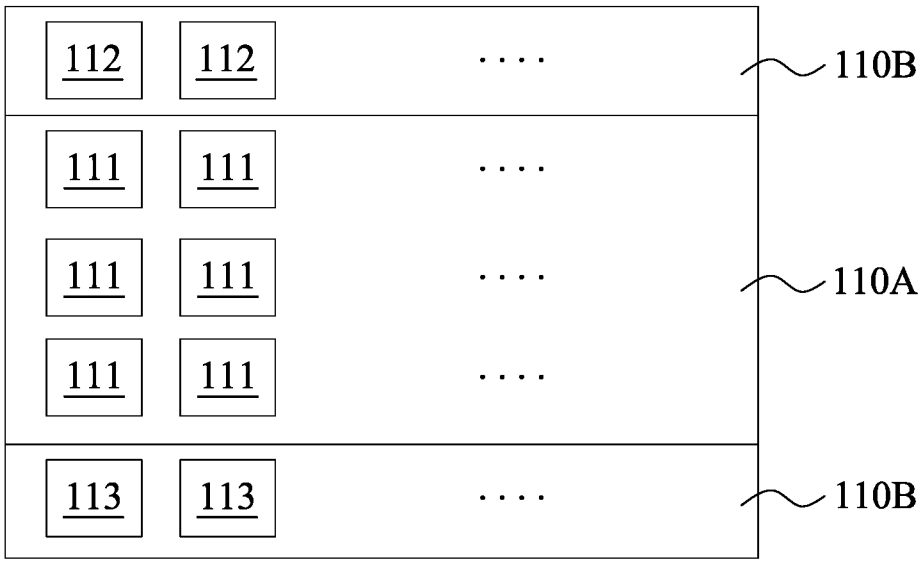
FIG. 5 is a schematic diagram of a display panel in some embodiments of the present disclosure.

As shown in FIG. 1A, in this embodiment, the first dummy pixel circuit 112 and the second dummy pixel circuit 113 are arranged on the same side of the display panel 110 adjacent to the display area 110A (e.g., corresponding to the same row of pixels, or located above or below the same column of pixels). FIG. 5 is a schematic diagram of a display panel in some embodiments of the present disclosure. In some other embodiments, the display panel 110 may include multiple first dummy pixel circuits 112 and multiple second dummy pixel circuits 113, and the first dummy pixel circuits 112 and the second dummy pixel circuits 113 may be respectively arranged on two corresponding sides of the display panel 110 corresponding to the display area 110A (e.g., corresponding to the same row of pixels, or on both sides of the same column of pixels).

Figure 6A:
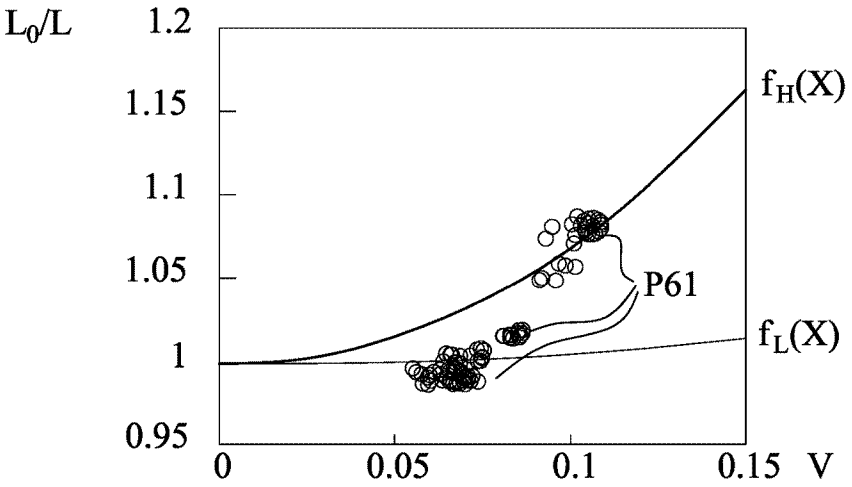
FIGS. 6A-6C are comparison diagrams of the driving method before and after compensation for the display device in some embodiments of the present disclosure.
Figure 6C:
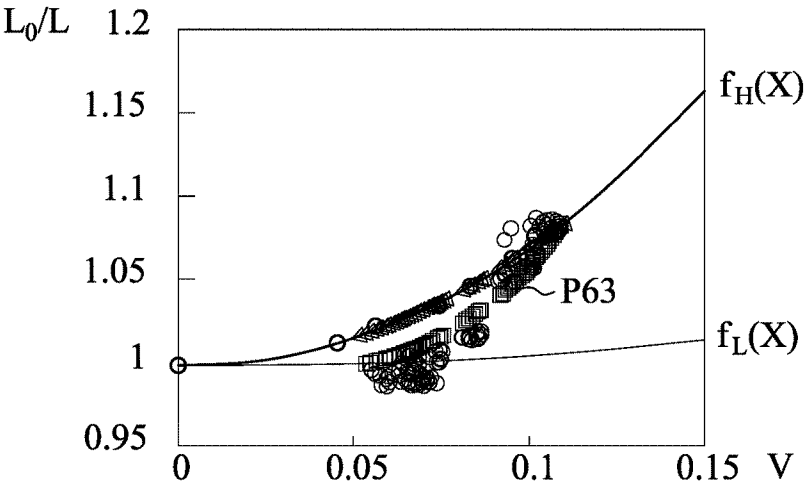
Figure 6B:
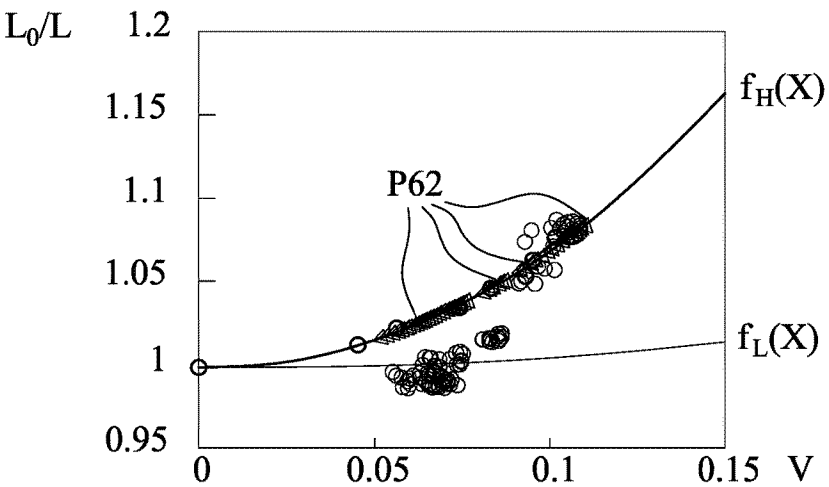

FIGS. 6A-6C are comparison diagrams of the driving method before and after compensation for the display device in some embodiments of the present disclosure. As shown in FIG. 6A, the multiple sampling points P61 are the detected voltage change value and the detected actual degradation degree of the light-emitting element of the display pixel circuit 111 after the display panel is driven for a period of time. As shown in figure, the distribution trend of sampling points P61 is different from the first degradation curve $f_H(x)$ and the second degradation curve $f_L(x)$.

As shown in FIG. 6B, the compensation points P62 in FIG. 6B is the result of the processor 120 only compensating the driving signal according to the first degradation curve $f_H$. Comparing FIG. 6A and FIG. 6B, it can be seen that there is a great difference between the compensation points P62 and the sampling points P61 regarding groups with less degradation. In other words, if the driving signal is compensated only according to the single degradation curve $f_H$, it will not be able to effectively eliminate the brightness distortion caused by degradation due to over compensation.

As shown in FIG. 6C, the estimated points P63 in FIG. 6C is the data after adjusting the driving signal according to the driving method of the present disclosure. Comparing FIG. 6A and FIG. 6C, it can be seen that the location and change trend of estimated points P63 are very close to sampling points P61. Therefore, the present disclosure can effectively improve the brightness distortion of the light-emitting element due to degradation.

Figure 7B:
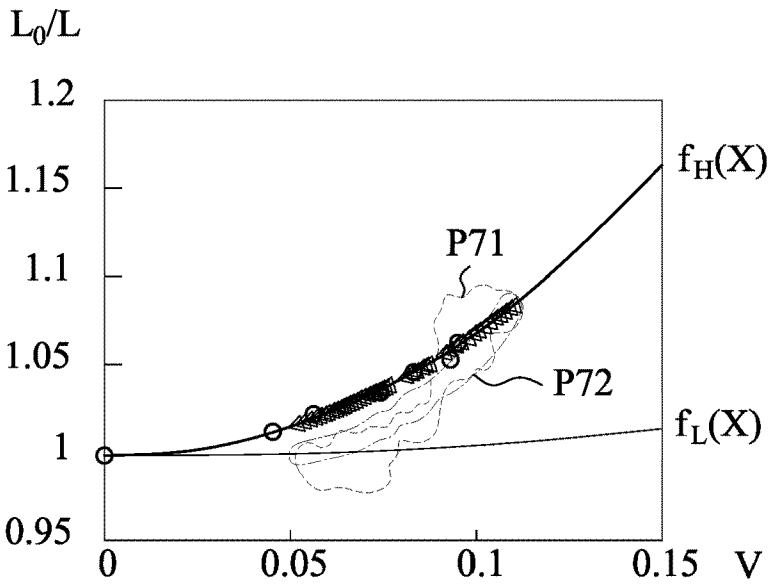
FIGS. 7A-7B are comparison diagrams of the driving method before and after compensation for the display device in some embodiments of the present disclosure.
Figure 7A:
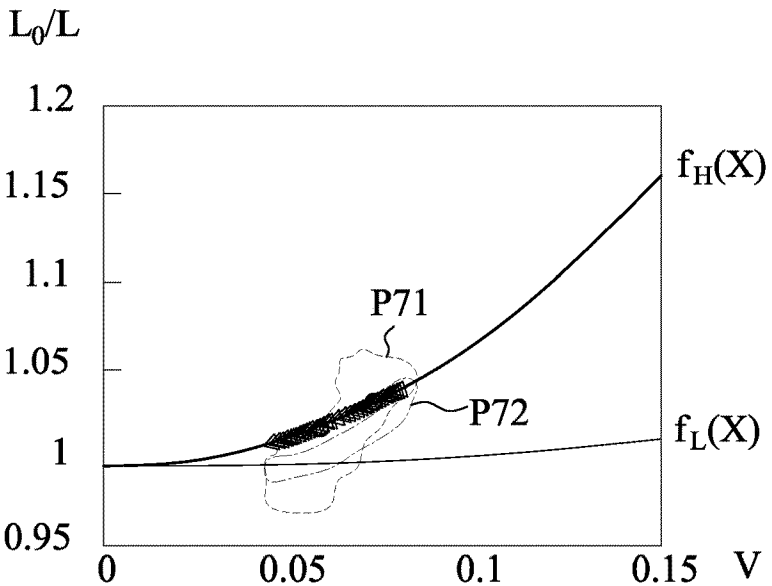

FIGS. 7A-7B are comparison diagrams of the driving method before and after compensation for the display device in some embodiments of the present disclosure. FIG. 7A shows the display device 100 after 48 hours of operation. FIG. 7B shows the display device 100 after 80 hours of operation. For clarity of illustration, the sampling points P71 (corresponding to the sampling points P61 in FIG. 6A) and the estimated points P72 (corresponding to the estimated points P63 in FIG. 6C) are drawn in the area of the distribution. As shown in FIG. 7A, the estimated points P72, which are generated according to the present disclosure, and the sampling point P71 (actual degradation data) almost coincide. Similarly, the estimated points P72 and the sampling points P71 in FIG. 7B almost coincide. In other words, the curve formed by the estimated points P72 will be automatically and dynamically adjusted with the operating time of the display device 100. Therefore, it can be ensured that the display device 100 maintains a high-quality display screen for a period of time, thereby improve the product life of the display device 100.

The elements, method steps, or technical features in the foregoing embodiments may be combined with each other, and are not limited to the order of the specification description or the order of the drawings in the present disclosure.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A driving method, comprising:

driving a first dummy pixel circuit according to a first test signal, and driving a display pixel circuit according to a driving signal, wherein the first test signal is maintained at a value corresponding to a first gray level;

detecting a detection voltage change value cross a light-emitting element in the display pixel circuit is driven for a driving time, and detecting a first test voltage change value cross a light-emitting element in the first dummy pixel circuit is driven for the driving time; and adjusting the driving signal according to the detection voltage change value, the first test voltage change value and a second test voltage change value, wherein the second test voltage change value is obtained by detecting a second dummy pixel circuit or from a memory unit.

2. The driving method of claim 1, wherein the second test voltage change value is a voltage variation after a light-emitting element is driven by a second test signal for the driving time, the second test voltage change value corresponds to a second gray level, and the second gray level is different from the first gray level.

3. The driving method of claim 2, wherein the first gray level corresponding to the first test signal is between 240-255, and the second gray level corresponding to the second gray level is between 0-10.

4. The driving method of claim 2, wherein a difference between the first gray level and the second gray level is larger than 200.

5. The driving method of claim 1, further comprising:

detecting a voltage variation during a light-emitting element in the second dummy pixel circuit for the driving time as the second test voltage change value.

6. The driving method of claim 1, further comprising:

determining a weight value according to a difference between the first test voltage change value and the second test voltage change value; and adjusting the driving signal according to the weight value.

7. The driving method of claim 6, further comprising:

obtaining a first degradation degree according to the first test voltage change value, and obtaining a second degradation degree according to the second test voltage change value; and obtaining an estimated degradation degree between first degradation degree and the second degradation degree according to the weight value.

8. A display device, comprising:

a display panel comprising a first dummy pixel circuit and a display pixel circuit, wherein the display panel is configured to drive the first dummy pixel circuit according to a first test signal, and drive the display pixel circuit according to a driving signal, the first test signal is maintained at a value corresponding to a first gray level; and a processor electrically coupled to the display panel, and configured to obtain a first test voltage change value cross a light-emitting element in the first dummy pixel circuit, and obtain a detection voltage change value cross a light-emitting element in the display pixel circuit, wherein the processor is configured to adjust the driving signal according to the detection voltage change value, the first test voltage change value and a second test voltage change value, and the second test voltage change value is obtained by detecting a second dummy pixel circuit or from a memory unit.

9. The display device of claim 8, wherein the display pixel circuit is arranged in a display area on the display panel, and the first dummy pixel circuit is arranged in a non-transparent area outside the display area.

10. The display device of claim 9, wherein the processor is configured to drive the display pixel circuit for a driving time, the second test voltage change value is a voltage variation after a light-emitting element is driven by a second test signal for the driving time, the second test voltage change value corresponds to a second gray level, and the second gray level is different from the first gray level.

11. The display device of claim 10, wherein the processor is further configured to determine a weight value according to a difference between the first test voltage change value and the second test voltage change value, and is further configured to adjust the driving signal according to the weight value.

12. The display device of claim 11, wherein the processor is further configured to obtain a first degradation degree according to the first test voltage change value, and is further configured to obtain a second degradation degree according to the first second voltage change value, the processor is further configured to obtain an estimated degradation degree between first degradation degree and the second degradation degree according to the weight value.

13. The display device of claim 9, wherein the display panel further comprises a second dummy pixel circuit, and is configured to drive the second dummy pixel circuit according to a second test signal, and the second test signal is maintained at a value corresponding to a second gray level.

14. The display device of claim 13, wherein the second dummy pixel circuit is arranged in the non-transparent area.

15. The display device of claim 13, wherein a difference between the first gray level and the second gray level is larger than 200.

16. The display device of claim 13, wherein the first dummy pixel circuit and the second dummy pixel circuit are arranged on a same side of the display area, or respectively arranged on two corresponding sides of the display area.

* * * * *